United States Patent [19]

Cordle et al.

[11] 3,992,998

[45] Nov. 23, 1976

[54] WARHEAD, PENETRATING NOSE SHAPE

[75] Inventors: Paul E. Cordle; Melvin J. McCubbin, both of China Lake; Clifford T. Johnson; James K. Brown, both of Ridgecrest, all of Calif.

[73] Assignee: The United States of America as represented by the Secretary of the Navy, Washington, D.C.

[22] Filed: Feb. 10, 1975

[21] Appl. No.: 548,725

[52] U.S. Cl. ..... 102/56 R; 102/59

[51] Int. Cl.[2] ..... F42B 13/12

[58] Field of Search ..... 102/56, 59, 67

[56] References Cited

UNITED STATES PATENTS

| | | | |
|---|---|---|---|
| 622,994 | 4/1899 | Chambers | 102/59 |
| 3,249,050 | 5/1966 | Cordle et al. | 102/67 |
| 3,690,257 | 9/1972 | Nooker et al. | 102/67 |

*Primary Examiner*—Verlin R. Pendegrass
*Attorney, Agent, or Firm*—R. S. Sciascia; Roy Miller; G. F. Baker

[57] ABSTRACT

The forward end of a warhead casing is structured to improve warhead penetration characteristics. The forward wall of the warhead casing is configured with thicker peripheral portions tapering to a thinner central portion and the warhead explosive is separated from the forward wall by a shock pad.

4 Claims, 2 Drawing Figures

WARHEAD, PENETRATING NOSE SHAPE

BACKGROUND OF THE INVENTION

When missile warheads, for example, impact upon hard targets, it is not unusual that the force of the impact will cause detonation of the warhead before the missile intelligence has commanded firing of the detonators provided. Even if warhead detonation is not premature, it is also not uncommon that excessive warhead breakup will occur before the detonation is commanded. Such premature detonation and warhead breakup is likely to result in only superficial damage to hard surface targets.

It is the particular object of this invention, therefore, to provide a warhead for a missile or the like which will penetrate a target as far as possible with as little damage to the warhead as possible so that damage to the target will be maximized.

According to the present invention, therefore, the warhead casing has been modified by increasing the case thickness at the forward end of the warhead and interposing a cushion of wax-based inert material, for example, at the forward end of the warhead between the warhead case and the explosive. A preferred material comprises about 65% of a gypsum compound such as Keen's Cement, 33% Castor Wax and 3% rosin.

DESCRIPTION AND OPERATION

Figure 1:
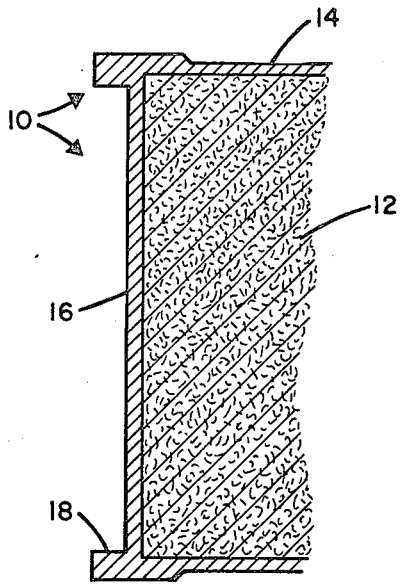
Fig. 1 PRIOR ART
FIG. 1 is a longitudinal cross sectional view of the front end of a missile warhead of conventional design.

A typical warhead for inclusion in a guided missile or the like is indicated generally by the numeral 10 in FIG. 1. The warhead consists essentially of a solid cylindrical explosive mass 12 surrounded by a cylindrical metal casing 14 closed by metal end walls. The forward end wall is shown at 16. The casing of the warhead 10 is shown enlarged and flanged at 18 to provide attachment to other portions of the missile body.

Figure 2:
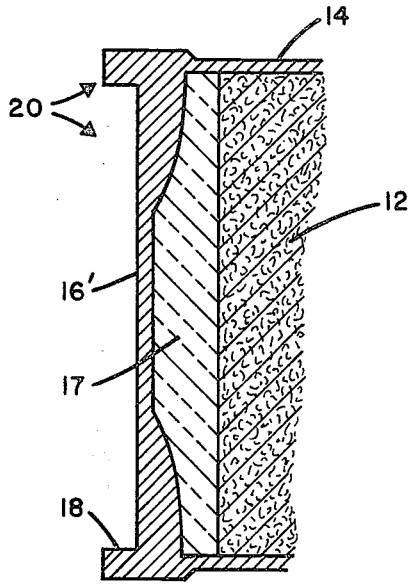
FIG. 2 is a longitudinal cross sectional view of a cylindrical missile warhead according to the present invention.

The modifications undertaken according to the present invention are illustrated in a missile warhead generally indicated at 30 in FIG. 2. The warhead casing 14 is essentially the same as in FIG. 1, but the forward wall 16' differs considerably from the end wall 16 of FIG. 1.

The end wall 16', for example, has a peripheral thickness of about one and one half times the usual thickness of end wall 16 and tapers in regular pattern from the outer periphery to the central section of the end wall as shown at 16' in FIG. 2. A contoured shock pad 17 is placed between this modified front wall and the explosive material 12.

It has been found that the configuration of FIG. 2 not only results in a warhead which has improved penetration characteristics but which also better withstands such safety tests as impact, fast cookoff and bullet impact.

Contributing to the safety and performance of this warhead is the choice of a less sensitive explosive charge such as composition B. Thus, the less sensitive explosive in combination with the shape of the forward wall and the shock pad, provide a missile warhead which will survice impact on a hard target for a sufficient length of time for the casing to penetrate the target and give a higher destruction capability to the missile.

What is claimed is:

1. A penetration warhead comprising in combination:

a substantially cylindrical metal casing having forward and rearward metal end walls;

an explosive material within said casing between said end walls;

said forward end wall being imperforate and formed integrally with said casing and having a substantially flat forward face and a contoured inner surface;

the central portion of said inner surface being substantially flat and spaced from said forward surface by a relatively normal thickness of metal;

said inner surface contour surrounding said central portion being such that the portion of said end wall surrounding said central portion is thickened gradually from said central portion outward to said casing; and a relatively thick contoured shock pad fitted between said inner surface and the forward end of said explosive material.

2. The warhead of claim 1 wherein said peripheral portion of said forward wall is on the order of one and one half times thicker than said central portion.

3. The warhead of claim 2 wherein said solid inert material comprises about 65% gypsum cement, 33% castor wax and 3% rosin.

4. The warhead of claim 1 wherein said solid inert material comprises about 65% gypsum cement, 33% castor wax and 3% rosin.

* * * * *